United States Patent [19]

Magnan

[11] Patent Number: 4,708,079

[45] Date of Patent: Nov. 24, 1987

[54] FLEX WING APPARATUS WITH RESILIENT COUPLINGS

[75] Inventor: Jeffrey J. Magnan, Orange County, Calif.

[73] Assignee: Gaastra Sails International Ltd., Hong Kong

[21] Appl. No.: 647,549

[22] Filed: Sep. 5, 1984

Related U.S. Application Data

[63] Continuation-in-part of Ser. No. 594,476, Mar. 28, 1984.

[51] Int. Cl.[4] ..... B63H 9/06

[52] U.S. Cl. ..... 114/103; 114/39.1; 114/39.2

[58] Field of Search ..... 114/39, 90, 102–104, 114/108, 97–99; 441/74

[56] References Cited

U.S. PATENT DOCUMENTS

| | | | |
|---|---|---|---|
| 737,118 | 8/1903 | Laughlin . | |
| 2,077,685 | 4/1937 | Gerhardt | 114/103 |
| 2,561,253 | 7/1951 | Wells-Coates | 114/102 |
| 2,569,318 | 9/1951 | Kersten | 114/103 |
| 2,589,203 | 3/1952 | Nilson | 114/103 |
| 3,141,435 | 7/1964 | Moffitt, Jr. | 114/39 |
| 3,147,729 | 9/1964 | Barnard | 114/103 |
| 3,331,348 | 7/1967 | Dyer | 114/90 |
| 3,593,356 | 7/1971 | Schmalfeldt | 114/39 |
| 3,795,215 | 3/1974 | Butler | 114/90 |
| 3,841,251 | 10/1974 | Larson | 114/39 |
| 3,866,558 | 2/1975 | Bergstrom | 114/90 |
| 3,882,810 | 5/1975 | Roeser | 114/112 |
| 3,885,804 | 9/1974 | Jackson | 114/90 |
| 4,016,823 | 4/1977 | Davis | 114/90 |
| 4,064,821 | 12/1977 | Roberts | 114/103 |
| 4,149,482 | 4/1979 | Hoyt | 114/106 |
| 4,267,790 | 5/1981 | Hood | 114/106 |
| 4,388,888 | 6/1983 | Gushurst | 114/95 |
| 4,418,631 | 12/1983 | Frohbach | 114/39 |
| 4,479,451 | 10/1984 | Lucht | 114/104 |
| 4,625,671 | 12/1986 | Nishimura | 114/103 |

FOREIGN PATENT DOCUMENTS

| | | | |
|---|---|---|---|
| 0083432 | 7/1983 | European Pat. Off. | 114/103 |
| 384075 | 10/1923 | Fed. Rep. of Germany | 114/103 |
| 3003529 | 8/1981 | Fed. Rep. of Germany | 114/97 |
| 58-61091 | 4/1983 | Japan | 114/39 |
| 58-61093 | 4/1983 | Japan | 114/39 |
| 2097741 | 11/1982 | United Kingdom | 114/39 |

*Primary Examiner*—Jeffrey V. Nase
*Assistant Examiner*—C. T. Bartz
*Attorney, Agent, or Firm*—Pollock, Vande Sande & Priddy

[57] ABSTRACT

A flex wing apparatus comprising a support, a mast coupled to the support and a sail. Battens are carried by the sail, and a coupling arrangement joins the leading edge of the battens to the mast so that the sail and battens can pivot about the mast. The battens can be resiliently deformed varying magnitudes to induce the desired camber into the battens and the sail. The coupling arrangement includes couplings each of which includes a collar and a pair of resilient legs.

7 Claims, 6 Drawing Figures

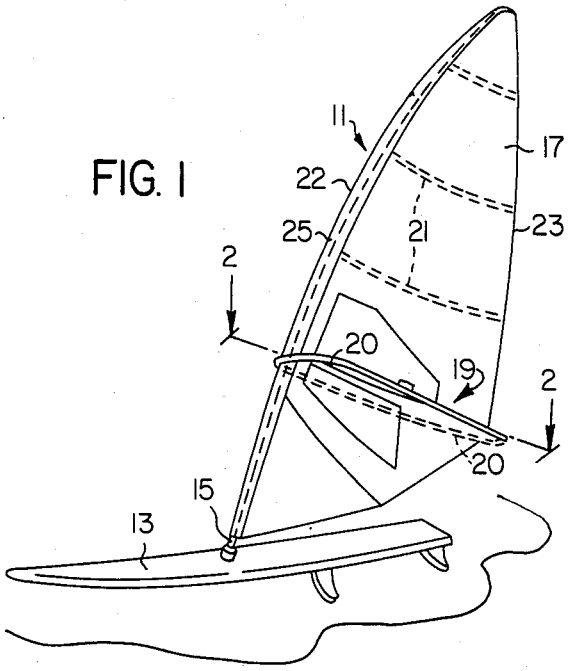
FIG. 1
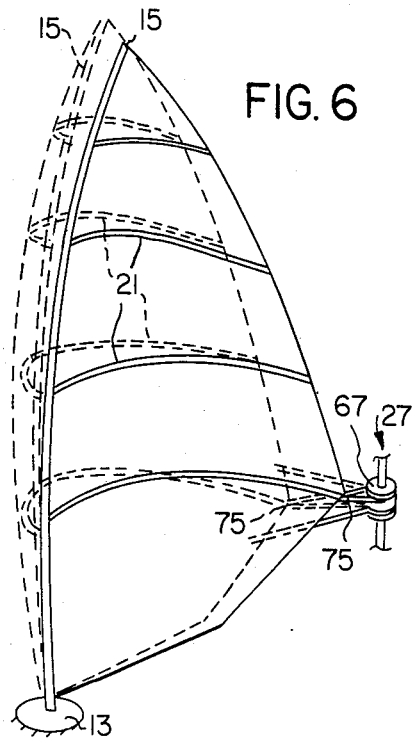
FIG. 6
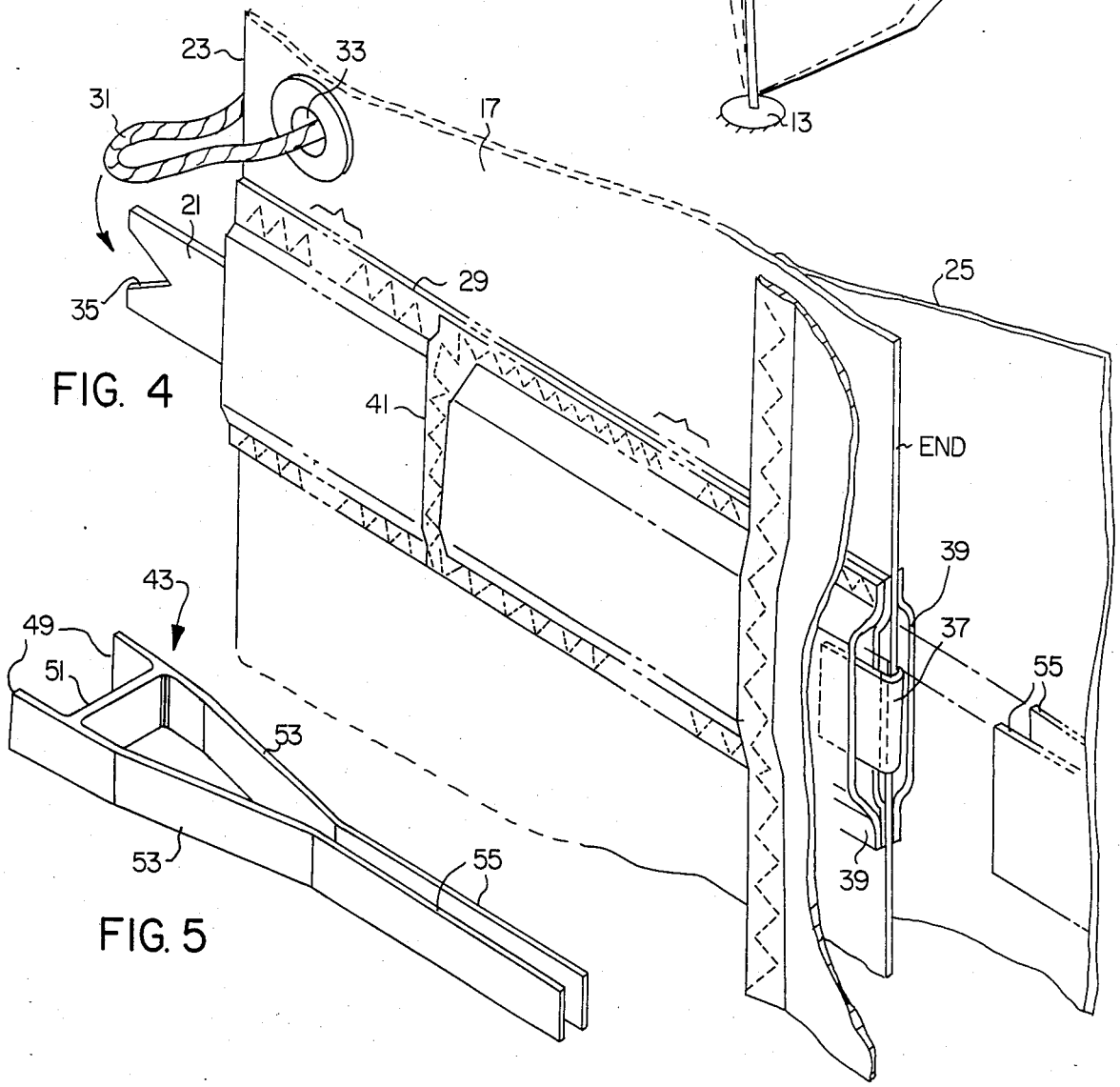
FIG. 4
FIG. 5

FLEX WING APPARATUS WITH RESILIENT COUPLINGS

This application is a continuation-in-part of Ser. No. 594,476; filed 3/28/84 and entitled flex wing apparatus.

BACKGROUND OF THE INVENTION

A flex wing apparatus is any apparatus which derives its support or motive power, in whole or in part, from a flexible wing. Example of flex wing apparati include sailboats, windsurfers, hang gliders and land sailing apparati.

The performance of a flex wing apparatus is dependent upon the efficiency of its flex wing. In order to tailor a flex wing for particular wind conditions, it is often necessary or desirable to adjust the camber of the wing.

For example, a sailboat or board sailing apparatus typically comprises a sail which is stiffened by resilient battens carried by batten pockets in the sail. The sail can be variably tensioned by an outhaul, and this can be used to provide some degree of camber adjustment in the sail. Unfortunately, however, when it is desired to increase the camber of the sail, the compressive forces on the battens push them forward around the sides of the mast thereby providing discontinuities in the wing and materially distorting the airfoil shape of the sail. This in turn reduces the efficiency of the sail and degrades performance.

In an effort to overcome this problem, it has been proposed to utilize a large, expensive mast of airfoil configuration and to couple the leading edges of the battens to the trailing edge of the mast. The mast is pivotable generally about its longitudinal axis, and with this arrangement, camber can be induced in the sail. However, in order to reduce the weight of this mast to an acceptable limit, it must be constructed of exotic expensive materials which make the cost of this construction very high.

SUMMARY OF THE INVENTION

This invention solves the problems noted above by providing a flex wing apparatus in which the desired camber can be induced into the wing. This is accomplished inexpensively using conventional inexpensive materials for the mast and without the need to construct the mast in an airfoil configuration. It is also not necessary to construct an airfoil-shaped envelope for the mast.

With this invention, coupling means couples the battens to the mast for pivotable movement of the battens and sail about the mast. The battens can be resiliently deformed varying magnitudes to induce the desired camber into the battens and the sail. Because the leading edges of the battens are pivotally coupled to the mast, the leading edges of the battens do not project around the mast to disrupt the airfoil configuration of the sail. Moreover, because the leading edges of the battens can pivot generally about the longitudinal axis of the mast, they enable the battens and sail to assume the desired airfoil configuration. The mast can be of simple, easily constructed cross sections, such as a circular cross section.

The battens can be compressively deformed in various ways. For example, in one known form of board sailing apparatus and sailboat, the mast is resilient, and the resilience of the mast can be used to deflect the battens. Alternatively, the tension in the sail, whether or not the mast is resilient, can be used to provide the force for deflecting the battens. The resilient deforming force can be controlled in the usual manner by an outhaul.

With this invention, the battens can support and tension the sail to a significant degree irrespective of wind conditions. This enables a sailboat or board sailing apparatus to sail closer into the wind and reduces or eliminates the tendency of the sail to luff.

The coupling means includes a plurality of couplings with each of the couplings having a collar at least partially surrounding the mast and rotatable about the mast and at least one resilient leg coupled to the collar. The coupling means also includes means for coupling the legs of the couplings to the sail with the legs being adjacent associatated battens so that the couplings can resist forward movement of the battens. With this construction, the couplings are captured between the mast and the sail. Because the legs of the coupling are resilient, they can be resiliently deflected transversely as camber is induced in the sail. As such, the couplings provide a more aerodynamic configuration for the leading end of the sail to improve the sail's efficiency.

Although the means for coupling the legs to the sail can take different forms, it preferably includes coupling pockets on the sail adjacent associated battens for receiving the legs of the coupling. In addition, the battens are preferably carried in batten pockets formed on the sail with the batten pockets having forward ends which are closed sufficiently to retain the leading end of the battens in the associated batten pocket against forward movement. With this construction, when tension is induced in the battens, the couplings are loaded against the mast, and the battens are coupled to the couplings without the need for separate fasteners. Preferably, the forward ends of the batten pockets hold the leading ends of the associated battens spaced from the collar of the associated coupling.

To enable the coupling to shape the leading end of the sail in two directions, each of the couplings preferably includes two resilient legs with the legs being on opposite sides of the associated batten. To enable the couplings to better shape the leading end of the sail, the legs preferably extend away from essentially the widest part of the collar. The legs preferably include inclined sections which are inclined toward each other as they extend away from the collar and generally parallel sections which extend away from the inclined sections and which are adapted to receive an end portion of a batten.

The features of this invention are applicable to any flex wing apparatus as defined above. However, the features of this invention are particularly applicable to sailboats and board sailing apparatus, and for this reason, the specific embodiment described hereinbelow is of a board sailing apparatus.

The invention, together with additional features and advantages thereof may best be understood by reference to the following description taken in connection with the accompanying illustrative drawing.

BRIEF DESCRIPTION OF THE DRAWINGS

FIG. 1 is an isometric view of a windsurfer constructed in accordance with the teachings of this invention.

FIG. 4 is a fragmentary isometric view of a section of the sail, one of the battens, and a portion of one of the couplings.

FIG. 5 is an isometric view of a preferred form of coupling.

FIG. 6 is a somewhat schematic, isometric view of a sail illustrating one way that the camber of the sail can be changed.

DESCRIPTION OF THE PREFERRED EMBODIMENT

Figure 2:
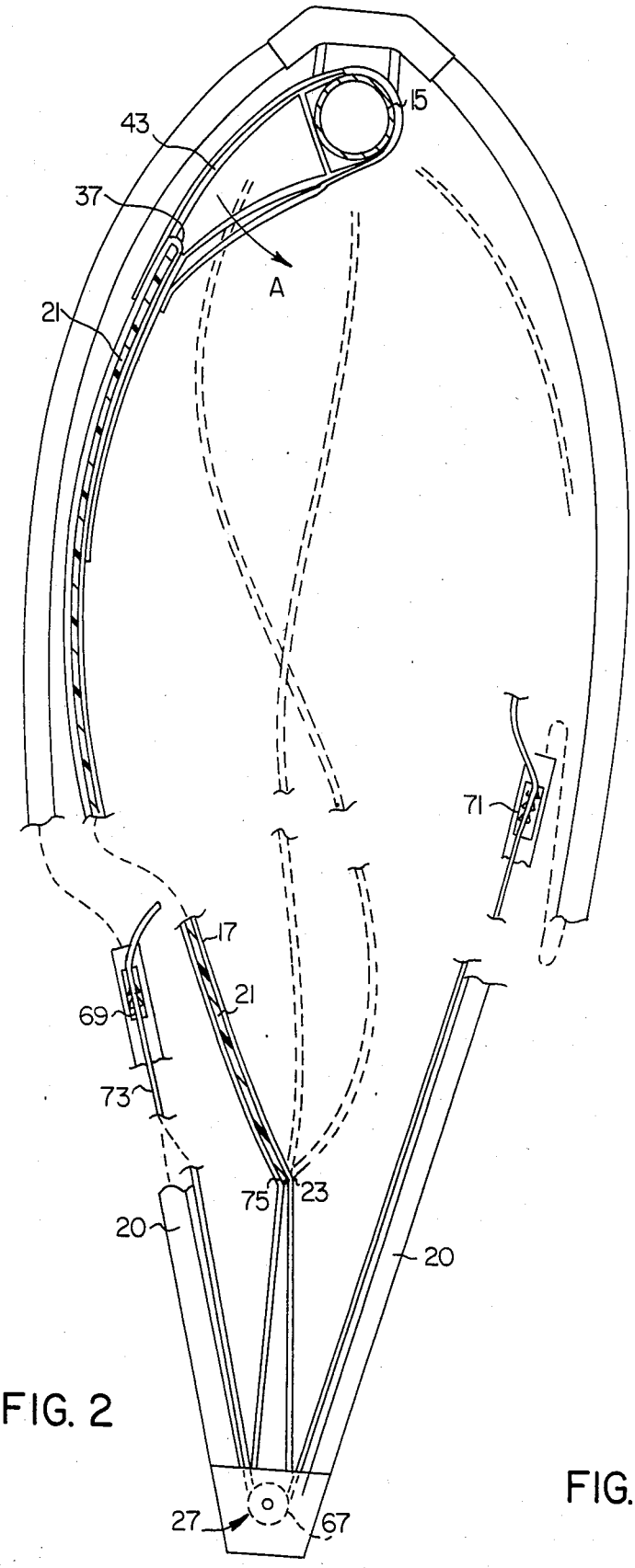
FIG. 2 is a sectional view taken generally along line 2—2 of FIG. 1.

FIG. 1 shows a board sailing apparatus 11 which generally comprises a buoyant support 13 in the form of a surfboard 13, a mast 15 coupled to the support and projecting generally upwardly therefrom, a sail 17 and a boom 19 coupled to the mast. In the embodiment illustrated, the boom 19 is a wishbone boom having two arms 20 on opposite sides of the sail 17. The sail 17 is stiffened, and its shape is controlled, at least in part, by battens 21 carried by the sail.

Figure 3:
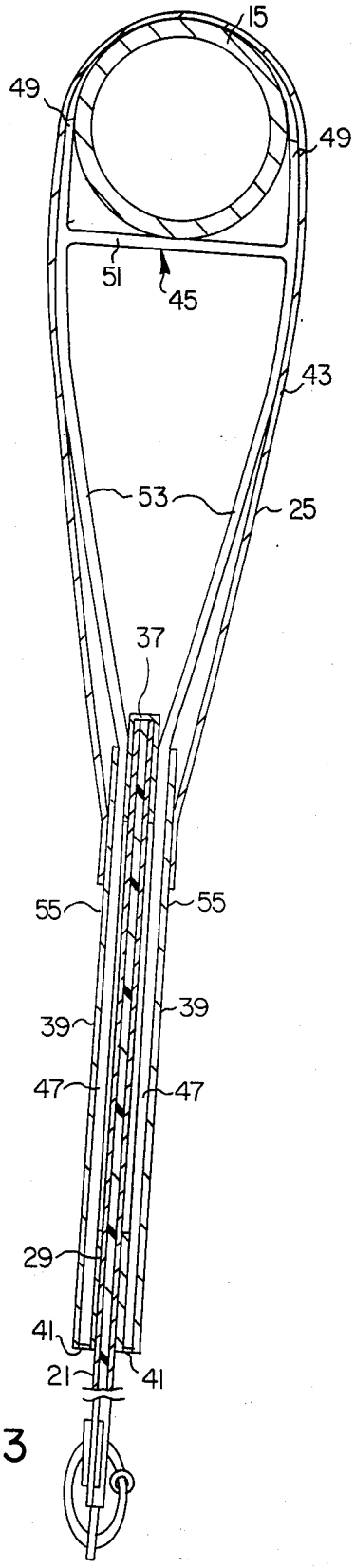
FIG. 3 is an enlarged sectional view taken generally along line 2—2 of FIG. 1 and illustrating the mast, the sail, a coupling and a batten with the sail essentially flat.

The sail 17 has a leading edge 22, a trailing edge 23 and a luff sleeve 25 along its leading edge, and as shown in FIG. 3, the sleeve 25 may be sewed onto a main portion of the sail. The mast 15 is received within the sleeve 25 as shown in FIG. 3. The sail 17 may be rigged in accordance with conventional practice, and except for the construction adjacent and within the sleeve 25, the windsurfer 11 may be of conventional construction.

The mast 15 is cylindrical and resilient and may be constructed of fiberglas or aluminum. As shown in FIG. 1, the mast 15 is curved rearwardly as it extends upwardly. Masts of this type are known, and such curvature is induced by tensioning the sail 17 using a conventional outhaul 27 (FIGS. 2 and 6) which couples the sail to the boom 19. Thus, the outhaul 27 controls the tension in the sail 17 and the deflection of the mast 15.

Each of the battens 21 is suitably carried by the sail 17, and this can be accomplished by a sail pocket 29 on the sail 17 which extends from the trailing edge 23 to a location within the sleeve 25 and adjacent the leading edge 22 of the sail. One batten 21 is provided in each of the batten pockets 29 in the usual manner, and the trailing end of each batten is suitably affixed to the sail as by a resilient, endless cord 31 (FIG. 4) which extends through an eyelet 33 in the sail 17 adjacent the trailing edge 23 and through a notch 35 in the trailing edge of the batten.

The leading end portion of the batten 21 and the pocket 29 project into the sleeve 25. The forward end of each of the batten pockets 29 is closed sufficiently to retain the leading end of the associated batten 21 therein against forward movement. In the embodiment illustrated, this is accomplished by a flap 37 (FIGS. 3 and 4) which is sewed over the forward end of the batten pocket 29. The sail 17 also has coupling pockets 39 (FIGS. 3 and 4) sewed to the sail 17 on opposite sides each of the batten pockets 29. Each of the coupling pockets 39 has a rearward or trailing end 41 which is closed as by sewing it shut. Preferably, the vertical dimension of each of the coupling pockets 39 is approximately equal to the vertical dimension of the associated batten pocket 29.

The leading ends of the battens 21 are coupled to the mast 15 by coupling means which includes the batten pockets 29, the coupling pockets 39, the luff sleeve 25 and identical couplings 43 located within the sleeve 25. The coupling 43, which may be molded from a suitable plastic material, comprises a collar 45 and resilient legs 47 coupled to the collar and extending away from the collar. The collar 45, which is generally channel shaped, includes spaced arms 49 integrally joined by a web 51 at the juncture between the arms 49 and the legs 47. The legs 47 include inclined sections 53 which are inclined toward each other as they extend away from the collar 45 and generally parallel sections 55 which extend away from the inclined sections at the distal ends of the inclined sections. The inclined sections 53 extend away from the widest part of the collar 45.

The arms 49 are spaced apart sufficiently to slidably receive and partially surround the mast 15 and the web 51 is also engageable with the mast 15 as shown in FIG. 3. The parallel sections 55 are spaced apart sufficiently to receive the leading end portion of the associated batten 21 and its batten pocket 29. The parallel sections 55 are receivable in the coupling pockets 39, respectively, on opposite sides of an associated batten 21. With this construction, the legs 55 are approximately centered in a vertical direction on the associated batten 21.

Each of the couplings 43 is preferably integrally molded from a suitable plastic material. Although the collar 45 could completely surround the mast 15, for ease of assembly, it is perferred to have the collar only partially surround the mast so that it can be assembled onto the mast by moving the collar radially toward the mast. Although various configurations are possible, the sections 53 and 55 are preferably straight, flat, elongated strips which extend in the same direction.

In the assembled condition, the couplings 43 are within the sleeve 25 and the sleeve retains the sail 17 on the mast 15. The collar 45 of each of the couplings is rotatably mounted on the mast 15 as shown in FIG. 3. The parallel sections 55 of the legs 47 are received within and bear against the closed trailing ends 41 of their associated coupling pockets 39. With this construction, forces tending to push the battens 21 toward the mast are transmitted via the flaps 37, the coupling pockets 39 and the couplings 43 to the mast. The battens 21 and the leading edge of the sail 17 can pivot about the longitudinal axis of the mast 15 by virtue of the pivoting action of the couplings 43 about the mast 15.

The camber of the sail 17 can be induced and varied as shown in FIGS. 2 and 6 using the outhaul 27. The outhaul 27, which is conventional, comprises a double pulley 67 carried by the trailing end of the boom 19, cleats 69 and 71 mounted on the arms 20, respectively, of the boom 19, and a line 73 extending from the cleat 69 around one roller of the pulley 67, through an eyelet 75 at the trailing edge 23 of the sail 17, back around a second roller of the pulley 67 to the cleat 71. When the line 73 is tensioned, it draws the trailing edge 23 of the sail 17 closer to the pulley 67 at the trailing end of the boom 19, and this tightly tensions the sail between the mast 15 and the trailing end of the boom 19 with the result that the mast 15 is resiliently deflected rearwardly.

The camber of the sail 17 can be increased by loosening the outhaul 27 to allow the mast 15 to straighten somewhat and to move the eyelet 75 forwardly so that the mast and sail are in the dashed-line position of FIG. 6. This forward motion of the trailing edge 23 of the sail 17 pushes the trailing end of the battens 21 forwardly toward the mast. However, because the flap 37 prevents forward motion of the battens 21, they deflect to increase their curvature and increase the camber of the airfoil formed by the sail 17. The couplings 43 slidably pivot clockwise as viewed in FIG. 4 about the mast 15 to allow the battens 21 to increase the camber of the sail 17. If this pivoting motion of the couplings 43 about the mast 15 were not allowed, the battens 21 would tend to buckle. The increased resilience of the leading end portions of the battens 21 enables them to impart the desired airfoil shape to the sail 17.

Conversely, to flatten the sail 17, the line 73 is further tensioned to pull the eyelet 75 rearwardly and to deflect the mast 15 rearwardly toward the full-line position of FIG. 6. This reduces the compressive forces on the battens 21. Accordingly, the couplings 43 pivot in the opposite direction about the mast 15 to permit a relative flattening of the airfoil shape of the sail. This pivoting movement of the couplings 43 about the mast 15 enables the camber of the sail 17 to be properly decreased. In coming about, the battens 21 can deflect as shown in dashed lines in FIG. 2, and the coupling 43 pivots on the mast 15 in the direction of the arrow "A."

An important function of the couplings 43 is to aerodynamically shape the sail 17 adjacent and along its leading edge 22. In this regard, the legs 47 allow the leading ends of the associated batten 21 to move transversely as the camber of the sail 17 is changed. Because the legs 47 are resilient, they smoothly bend as shown in FIG. 2 to efficiently shape the sail 17 adjacent and along its leading edge 22. In addition, the wide portion of the coupling 43 adjacent the opposite ends of the web 45 maintains an aerodynamic configuration for the sail at the locations along the sail which contact this portion of the coupling. Aft of these locations, the resilient legs 47 serve to shape the sail regardless of the amount of camber which is induced into the sail.

Another feature of this invention is that the couplings 43 are appropriately coupled to the sail 17 without using separate fasteners. This simplifies the construction and facilitates assembly.

Although an exemplary embodiment of the invention has been shown and described, many changes, modifications and substitutions may be made by one having ordinary skill in the art without necessarily departing from the spirit and scope of this invention.

I claim:

1. A flex wing apparatus comprising:

a support;

a mast coupled to the support and projecting therefrom;

a sail of flexible material, said sail having a leading edge, a trailing edge and a luff sleeve at the leading edge for receiving the mast;

a plurality of resilient battens, each of said battens having leading and trailing ends;

batten pockets on the sail for carrying the battens, respectively, with the battens extending toward the leading edge of the sail; at least one of said batten pockets having a forward end which is closed sufficiently to retain the leading end of the batten therein against forward movement;

coupling means for coupling the battens to the mast for pivotal movement of the battens and sail about the mast;

said coupling means including a plurality of couplings within said luff sleeve, each of said couplings having a collar at least partially surrounding the mast and rotatable about the mast and at least one resilient legs coupled to said collar;

said coupling means including coupling pockets on the sail for respectively receiving said legs and coupling said legs to the sail with the legs being adjacent associated battens and for resisting forward movement of the battens; and means for resiliently deforming the battens varying magnitudes to induce the desired camber into the battens and the sail.

2. A flex wing apparatus according to claim 1 wherein said leg of each of said couplings is a first leg, at least one of said couplings includes a second resilient leg with said first and second legs of said one coupling being on opposite sides of the associated batten, said forward ends of said batten pockets holding the leading ends of the associated battens spaced from said collar of the associated couplings.

3. A flex wing apparatus comprising:

a support;

a mast coupled to the support and projecting therefrom;

a sail of flexible material, said sail having a leading edge and a trailing edge;

a plurality of resilient battens;

means on the sail for carrying the battens with the battens extending toward the leading edge of the sail;

coupling means for coupling the battens to the mast for pivotal movement of the battens and sail about the mast;

said coupling means including a plurality of couplings, each of said couplings having a collar at least partially surrounding and rotatable about the mast and at least one resilient leg coupled to said collar, said coupling means including coupling pockets on the sail adjacent associated battens for receiving said legs, respectively; and means for resiliently deforming the battens varying magnitudes to induce the desired camber into the battens and the sail.

4. An apparatus as defined in claim 3 wherein said sail has a sleeve at its leading edge and said sleeve receives at least a portion of said mast and said coupling means.

5. An apparatus as defined in claim 3 wherein said support includes a buoyant structure capable of floating on water.

6. An apparatus as defined in claim 3 wherein the batten carrying means holds the leading ends of the battens spaced from said collars of the associated couplings.

7. An apparatus as defined in claim 3 wherein said leg of each of said couplings is a first leg, at least one of said couplings includes a second resilient leg with said first and second legs of said one coupling being on opposite sides of the associated batten.

* * * * *